United States Patent [19]

Campbell et al.

[11] 4,176,578

[45] Dec. 4, 1979

[54] SYSTEM FOR ENCODING OF BASS AND TREBLE EXPRESSION EFFECTS WHILE RECORDING FROM THE KEYBOARD OF AN ELECTRONIC PLAYER PIANO

[75] Inventors: Joseph M. Campbell, Lewisburg; Larry J. Minyard, Columbia, both of Tenn.

[73] Assignee: Teledyne Industries, Inc., Los Angeles, Calif.

[21] Appl. No.: 828,070

[22] Filed: Aug. 26, 1977

[51] Int. Cl.[2] ..... G10F 5/00; G10G 3/04

[52] U.S. Cl. ..... 84/115; 84/1.1; 84/1.27; 84/462; 84/DIG. 29

[58] Field of Search ..... 84/1.01–1.03, 84/1.24, 1.28, 115, 462, DIG. 29, 1.1, 1.27

[56] References Cited

U.S. PATENT DOCUMENTS

| | | | |
|---|---|---|---|
| 3,683,096 | 8/1972 | Peterson et al. | 84/115 |
| 3,895,554 | 7/1975 | Maillet | 84/115 |
| 4,023,456 | 5/1977 | Groeschel | 84/115 |
| 4,104,950 | 8/1978 | Finley | 84/462 |
| 4,132,141 | 1/1979 | Campbell et al. | 84/115 |
| 4,132,142 | 1/1979 | Campbell | 84/115 |
| 4,135,428 | 1/1979 | Campbell | 84/1.24 |

*Primary Examiner*—S. J. Witkowski
*Attorney, Agent, or Firm*—Jim Zegeer

[57] ABSTRACT

There is disclosed a system for encoding of bass and treble expression effects while recording from the keyboard of an electronic player piano wherein the intensity of the music being recorded is reflected in variations in the power of the acoustic waveform produced thereby. The key note or key switch actuations are multiplexed in a serial bit stream of data and stored in a shift register and then separately combined with the bass and treble expression data bits in a format which, upon re-creation of the original musical presentation, results in a more faithful rendition of the original performance.

9 Claims, 5 Drawing Figures

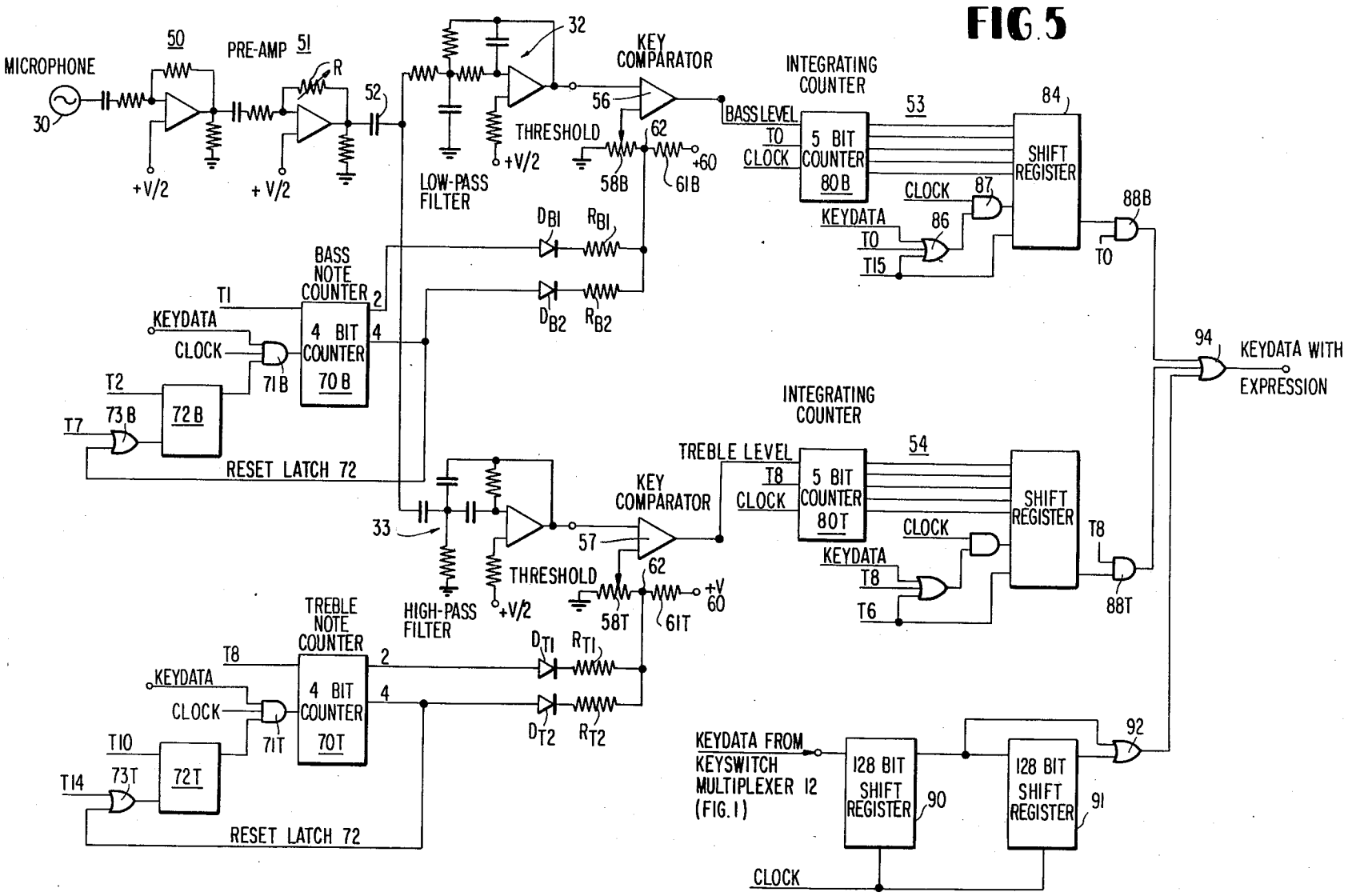
FIG. 5
KEYDATA WITH EXPRESSION
94
88B
T0
88T
T8
92
84
SHIFT REGISTER
87
86
CLOCK
T0
T15
KEYDATA
53
INTEGRATING COUNTER
5 BIT COUNTER
80B
BASS LEVEL
T0
CLOCK
54
SHIFT REGISTER
CLOCK
T8
T6
KEYDATA
INTEGRATING COUNTER
5 BIT COUNTER
80T
TREBLE LEVEL
T8
CLOCK
128 BIT SHIFT REGISTER
91
128 BIT SHIFT REGISTER
90
KEYDATA FROM KEYSWITCH MULTIPLEXER 12 (FIG. 1)
CLOCK
KEY COMPARATOR
+60
61B
62
58B
56
THRESHOLD
+V/2
32
LOW-PASS FILTER
RB1
RB2
DB1
DB2
KEY COMPARATOR
+V 60
61T
62
58T
57
THRESHOLD
+V/2
HIGH-PASS FILTER
33
RT1
RT2
DT1
DT2
52
PRE-AMP
51
R
+V/2
50
+V/2
MICROPHONE
30
BASS NOTE COUNTER
2
4
4 BIT COUNTER
70B
71B
T1
KEYDATA
CLOCK
72B
T2
73B
T7
RESET LATCH 72
TREBLE NOTE COUNTER
2
4
4 BIT COUNTER
70T
71T
T8
KEYDATA
CLOCK
72T
T10
73T
T14
RESET LATCH 72

SYSTEM FOR ENCODING OF BASS AND TREBLE EXPRESSION EFFECTS WHILE RECORDING FROM THE KEYBOARD OF AN ELECTRONIC PLAYER PIANO

REFERENCE TO RELATED APPLICATIONS

This application is related to Campbell application Ser. No. 828,069, entitled "Method and Apparatus for Recording a Digital Signals for Actuation Solenoids" and Campbell et al. application Ser. No. 828,068, entitled "Method and Apparatus for Encoding of Expression While Recording from the Keyboard of an Electronic Player Piano" both filed concurrently herewith all owned by the assignee hereof.

BACKGROUND OF THE INVENTION AND BRIEF DESCRIPTION THEREOF

The present invention relates to a method and apparatus for recording keyboard music for re-creation on a similar keyboard instrument by actuation of the keys and, more particularly, to the detection, encoding, recording and reproduction of expression effects on electronic keyboard instruments. Expression control has been provided in a number of ways in the prior art. For example, transducers, such as microphones, accelerometers or magnetic pickups produce analog voltages which are proportional to the intensity with which the keys are struck. The analog information is then digitized in an analog to digital converter and combined with the keyboard switch actuation signals. These prior art systems do not take into account the delay between which the key switch is actuated and the actual production of the musical note involved nor do they take into account the mechanical differences between the production of notes in the treble range as compared to the production of notes in the bass range. The digital multiplex word format placed the expression bits for both bass expression and treble expression in one position in each frame.

According to this invention the key data from the key switch multiplexer is applied to a pair of serially connected 128-bit shift registers. The output of the first shift register is supplied to the second shift register and to an OR gate along with the output of the second shift register so that every key switch closure or actuation extends over two time frames and is, in effect, a note stretcher. This note stretching removes the very sharp and mechanical sound from short notes.

The key switch closures (data bits) are divided into two groups, bass and treble, in each time frame of data cells, the first group being assigned to a first group of data cells in the time frame and the second group or set of data cells being adapted to receive the second group of key switch closures (data bits). According to the invention the bass expression bits are inserted into data cells in each time frame in a position just in advance of the data cells containing the key switch closures of the group the expression data pertains to. Thus the bass expression bits are carried in data cells in the time frames preceding and contiguous to the bass note data cells and the treble note expression bits are carried in bit or data cell positions of the time frame just preceding the cells assigned to carry treble note data bits. This format or bit assignment assures a closer and more faithful rendition and reproduction of the original musical presentation.

BRIEF DESCRIPTION OF THE DRAWINGS

The above and other objects, advantages and features of the invention will become more apparent when considered in conjunction with the following specification and accompanying drawings wherein:

FIG. 5 is a schematic block diagram of a circuit which incorporates the invention.

Referring now to FIG. 1, the keyboard of a piano (not shown) is designated by the numeral 10 as a keyboard data source. It could be any musical instrument such as a harpsichord, carillon, organ, piano, etc. and each output or switch actuation is indicated by a single line 11-1 through 11-N, the number of such output lines corresponding to the number of key switch actuations to be sensed and recorded, for example, 80 keys for the notes 4–82 of a standard piano, the note at each extreme end of the keyboard not being recorded but they could very easily be recorded in the 128-bit frame format utilized herein (see FIG. 2). In addition, the "sustain" and "soft" pedals may be equipped with similar switches and the actuation of these switches sensed in the same way.

Multiplexer 12, which is supplied by timing pulses from a clock or timing source 9, looks at or scans each individual line 11-1 . . . 11-N in a time sequence which constitutes a frame. Thus, the key switches, the sustain and soft pedal actuations are sensed by the digital multiplexer 12, one at a time, and in a generally sequential fashion. If no transpositions are contemplated, it is not necessary that they be sequentially scanned, they may in this case be looked at or scanned in groups in any fashion or order, the only criteria being that the position of the particular switch in its scan time be maintained in the entire system. FIG. 2 illustrates the bit assignment chart for 88 keys of the piano, and as indicated above, only notes 4–84 need be utilized for accurate and satisfactory reproduction of the music being played, although the entire keyboard may obviously be utilized.

Figure 2:
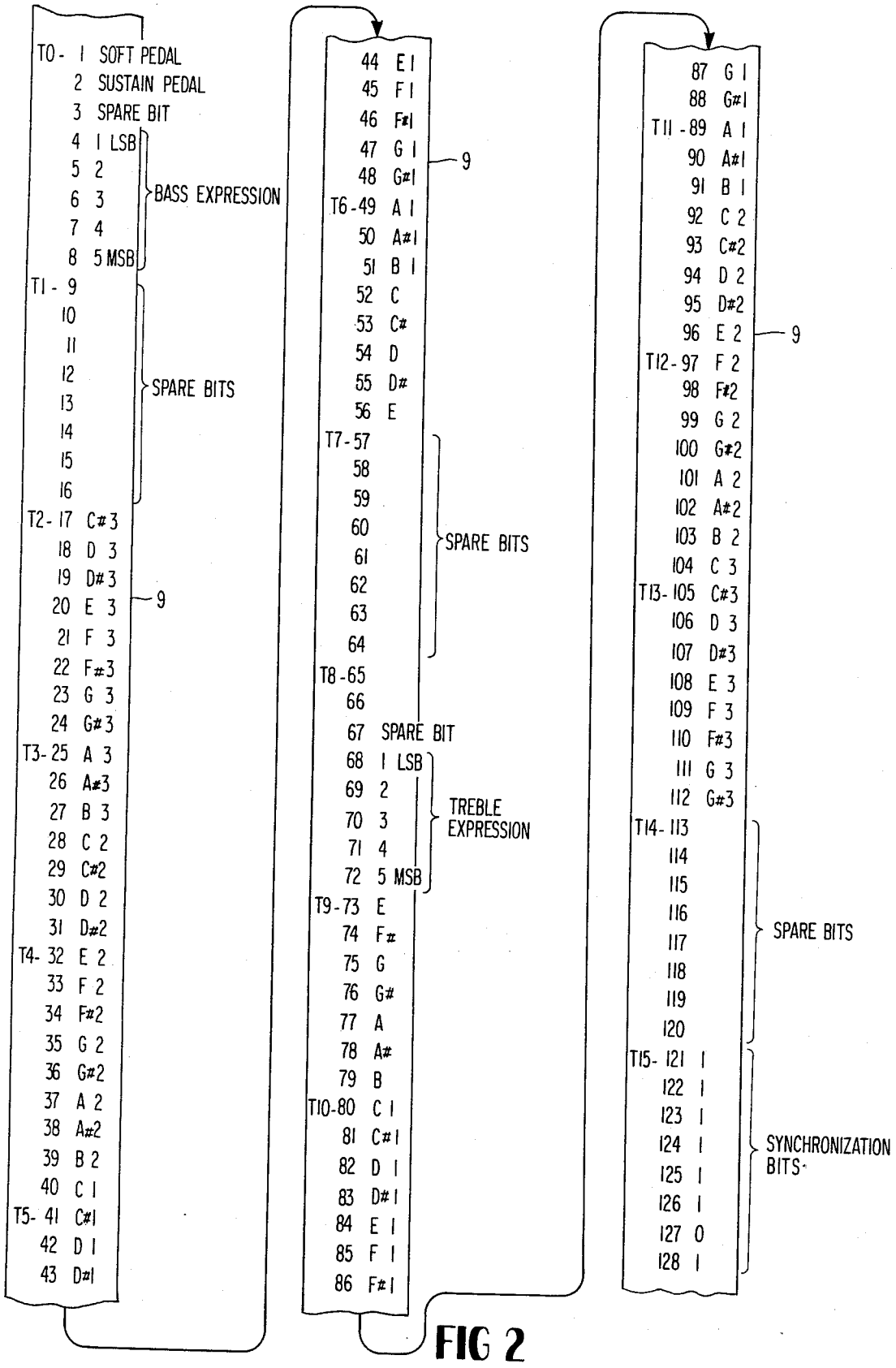
FIG. 2 is a bit (or data cell) assignment chart, for each frame of multiplexed data as same would diagrammatically appear on a length of magnetic tape (not to scale)

As illustrated in the bit assignment on the magnetic tape 9 shown in FIG. 2, bit positions 1 and 2 are for the soft and sustain pedals. Bit position 3 is a spare bit and is simply not used in this embodiment. Bit positions 4–8 are 5-bit positions which are utilized for the bass expression, the first bit position of the bass expression group, bit position 4, being the least significant bit ("LSB") and bit position 8 being for the fifth bit of the bass expression group and records the most significant bit ("MSB"). Bit positions 9 through 16 are spare bits and may be used for recording, for example, the four bass notes which are not used in this embodiment. Bit positions 17 through 56 are used for recording the bass note key switch actuations. It will be noted that in this embodiment the bass note expression bits are recorded close to the bass note key switch actuations themselves.

Bit positions 57–64 are spare bit positions and may be used for inserting other data into each frame, if desired.

Bit positions 65 an 66 are used for recording the digital code word identifying the particular format of roll music which may be transcribed. In the case of a normal recording according to the present invention, these bit positions are not used. Bit position 67 is a spare bit position and is not used. Bit positions 68–72 are used to record the treble expression bits, with the first bit being the least significant bit ("LSB") and the fifth bit being the most significant bit ("MSB"). Bit positions 73–112, inclusive, are used for recording the treble note key switch actuations. Bit positions 113–120 are spare bits and bit positions 121–128 are for storing the synchronization bits.

Referring again to FIG. 1, a synchronizing generator 10-S which generates the sync word shown in bit positions 121–128, supplies the sync word on lines 11-S to the multiplexer. The pedal controls for the sustain pedal and the soft pedal are recorded in bit positions 1 and 2 as indicated above.

Expression bit information from the expression control circuit EC (shown in block diagram form in FIG. 3 and in detailed schematic form in FIG. 5) of the present invention, which will be described more fully hereafter, is combined via OR gate 94 (see FIG. 5) to form the data frame shown in FIG. 2. The output from the OR gate 94 on line 13 is supplied to an encoder 14, which is preferably a bi-phase space/mark encoder. The output of the encoder on line 14-0 is supplied to a tape recorder and playback unit 15 which records the encoded data on line 14 on a magnetic tape cassette 9, diagrammatically shown as having the cyclically repeated sequence of time slots 1–128 of serial frames n, n+1, n+2, . . . and so forth, magnetically recorded thereon. The information which is recorded on the magnetic tape are serial frames of data which have the bit assignments shown in FIG. 2. Since the data is encoded in a bi-phase space/-mark encoder, it is a self-clocking signal which has sharp transitions in the magnetic flux at the beginning (or end) of each bit position or data cell with a transition or an absence of a transition in the middle of a data cell constituting the recording key switch actuations, expression bits, etc. information, one such data cell 75 (for the note "A") carried in frame n is shown as having the same bit for the note ("A") repeated in corresponding time slot or data cell 75 of the next succeeding frame n+1 for playing of the note ("A") even though nothing was sampled at the key switch for position 75 during the multiplexing operation for frame n+1. Such an encoding system is disclosed in the "Service Manual" for Teledyne Piano Recorder/Player Model PP-1, Assembly No. 3288 ATL3263, a publication of the assignee hereof and U.S. Application Ser. No. 681,093 by J. M. Campbell, filed Apr. 28, 1976, also assigned to the assignee hereof and now U.S. Pat. No. 4,132,142, both incorporated herein by reference.

During playback, the tape 9 is placed in the tape recorder/playback unit 15 and the encoded data appears on the output of the read head and is fed through conventional correcting networks and amplifiers to recover the digital signal which appears on the output line 16. This signal has included therein the clock data as part of the encoded signal and when this clock signal is recovered it is used along with the other information not here relevant in time recovery circuit 17-R and supplied to demultiplexer and latch circuits 18. In this commercially available unit, the data from the decoder 17 is supplied on output lines 17-0 to the demultiplexer unit 18 which distributes the data to the appropriate control channels and the storage and solenoid actuator circ uits 19-K, for the keyboard data, 19-E for the expression data, and 19-P for the pedal data, and 19-A for the auxiliary data which may or may not one of the unassigned bits shown in the data assignment chart of FIG. 2. While in the present invention it is preferred that the bass expression bits be recorded close to and in advance of the bass bits and that the treble expression bits be recorded as close to and in advance of the treble notes, this is not a necessary requirement of the invention. However, it does assure that a more faithful rendition of the music as originally played in performed in the playback mode.

Figure 3:
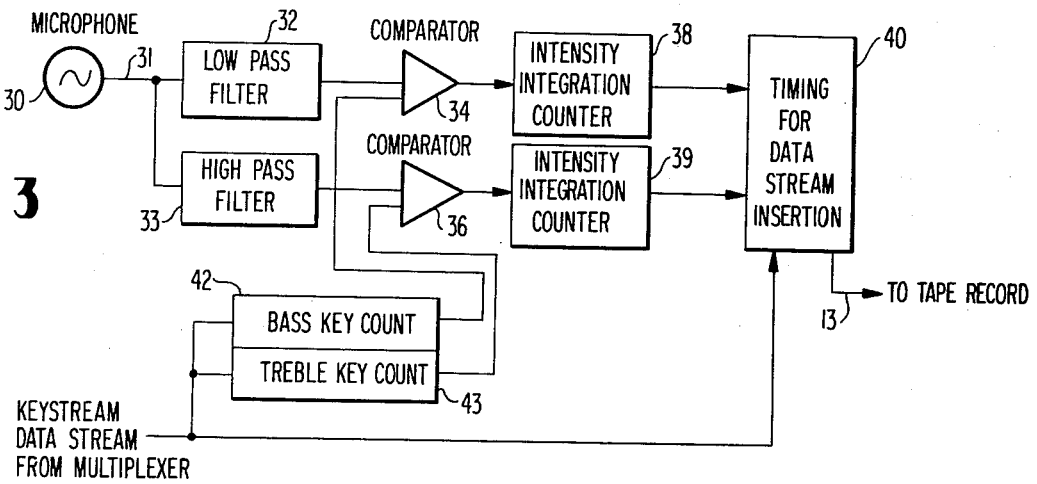
FIG. 3 is a block diagram of the expression recording circuit incorporating the invention, FIG. 4 are waveform diagrams which illustrate the basic principle of the expression recording system of the present invention.
Figure 4:
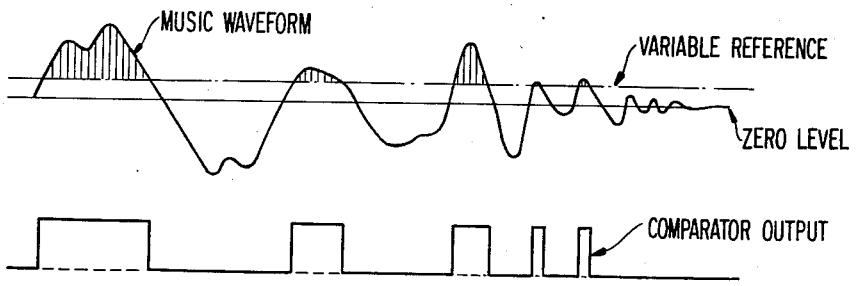

Referring now to FIG. 3, a block diagram of the expression detecting and encoding circuit is shown and includes a simple microphone 30 for detecting the acoustic wave as produced by the striking of one or more notes of the keyboard of a piano, for example. This acoustic wave is supplied on line 31 to a low pass filter 32 for the ass notes and a high pass filter 33 for the treble notes. The outputs of these two filters are respectively applied to comparators 34 and 36 which, with integration counters 38 and 39, perform a digital integration of the waveform (see FIG. 4). The electrical waveforms from the microphone as passed by the low pass filter 32 and the high pass filters 33 can take the form shown in FIG. 4. The other input to the comparator is an adjustable or programmable threshold level. Whenever the music waveform shown in FIG. 4 is greater than the threshold, a clocking circuit is allowed to advance a counter (described in greater detail in connection with FIG. 5) which is a binary 5-count unit with a 31-count range. The counting system is adjusted by presetting the basic d.c. level so that the maximum volume required from the piano produces the maximum count (31) from the counter. Thus, the longer the music waveform is above the threshold, the higher the expression stored. This integrating system can be adjusted to compensate for the higher frequency and thus the lower counts of the treble notes by setting the basic threshold of the treble comparator slightly lower than that of the bass comparator. The reason for this is that the treble notes have to be struck harder to get the same volume as the bass. Thus, in the block diagrams herein shown, the intensity integration counters 38 and 39 thereby produce a group of data bits which are the binary value for the intensity level to be recorded. These signals are then applied to a timing for data stream insertion circuit 40 which combines the key switch data stream with the expression bit, both treble and bass, and supplies the frames of time division multiplex frames of data on line 41 to the bi-phase encoder of FIG. 1. The system also compensates for the playing of more than one note by counting the number of notes played and automatically raising the threshold when multiple notes are sounded and as shown in FIG. 3, the key switch data stream is supplied to a bass key count circuit 42 and a treble key count circuit 43 which, as shown in FIG. 5 includes the system for setting the threshold level of the comparators 34 and 36, respectively.

Referring now to FIG. 5, microphone 30 has its output coupled through a pair of tandem-connected pre-amplifiers 50 and 51, respectively, the feedback resistor R of pre-amplifier 51 being adjustable for signal compensation purposes. The output of the pre-amplifier 51 is coupled via a coupling capacitor 52 to a low pass filter network 32 of conventional design to provide a low frequency below 330 Hertz and through a high band pass filter 33 to provide a high frequency portion, above 330 Hertz of the music waveform. The filter outputs are fed to a key note comparator circuit, 56 for the bass notes and 57 for the treble notes which serve as analog to digital conversion means. The integrating counters develop a numerical value for the intensity of the bass and treble notes being played. The audio portion of the expression recording circuit operational operationl amplifiers, such as National Semi-Conductor 324A, to realize both the pre-amplifier for a microphone output, the acting low pass and high pass filters 32 and 33, and the key note adjustment comparators 56 and 57, respectively. As noted above, the key note comparators 56 and 57 provide a threshold with which the filter outputs are compared to enable the integrating counters 53 and 54 and the output of the key comparator is shown in FIG. 4. The variable reference level is adjusted in the first instance by a potentiometers 58T and 58B from d.c. source 60 which is connected via dropping resistor 61 to a common point 62. The threshold is adjusted based upon a number of keys played to scale the integrator output count appropriately. The integrator works by simply counting the amount of time that the filter output signal is above the threshold level and storing this count to be inserted in the data stream along with the key data and at the proper time.

Figure 1:
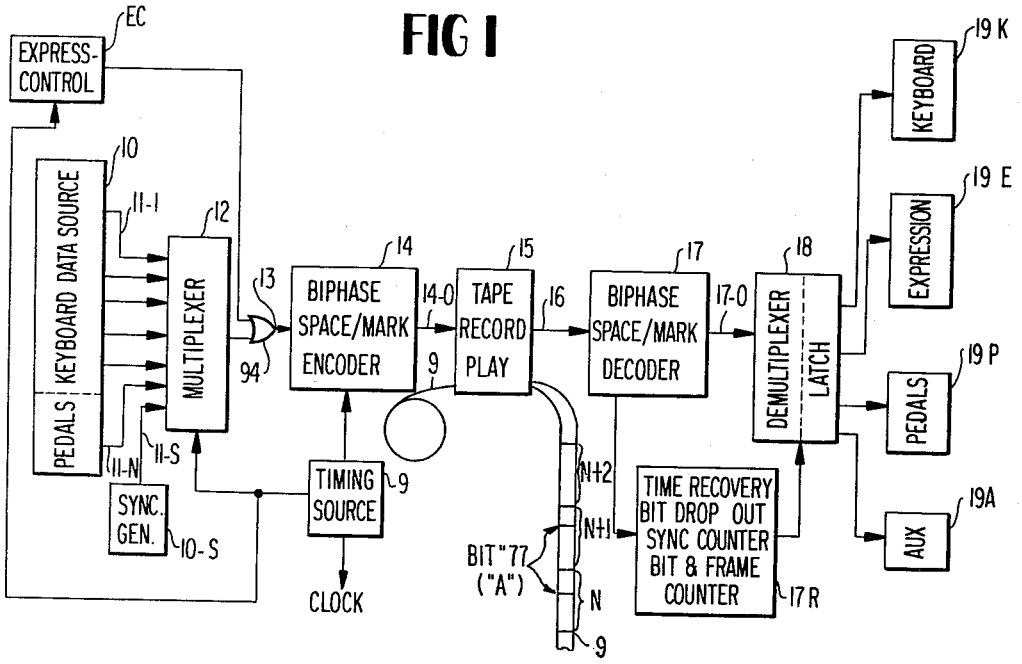
FIG. 1 is a diagrammatic block diagram of a player piano recorder system to which the invention has been applied.

In the multiplexer shown in FIG. 1, as disclosed in the U.S. Pat. No. 4,132,142, while there are 128 data bits or time cells in each frame, these are divided into sixteen units of eight cells each, and there are produced in the timing circuit of the multiplexer sixteen timing pulses which are denoted T0 . . . T-15 (see FIG. 2 for the relative position of these pulses) and these identify the timing of the beginning of each group of words as follows:

| | | | | | | | |
|---|---|---|---|---|---|---|---|
| TO Bass Expression | T1 Spare | T2 Bass | T3 Note | T4 Key | T5 Data | T6 | T7 Spare |
| T8 Treble Expression | T9 Treble | T10 Note | T11 Key | T12 Data | T13 | T14 Spare | T15 Synch-word |

The above times are indicated at various places in FIG. 5 and provide the timing for setting the variable threshold of the key comparator as well as providing the time for insertion of the expression data bits in the key data stream from the multiplexer.

It is noted that the bass expression is initiated at time T0 and at time T1, a bass note counter (4-bit counter 70B) is initiated or turned on to begin counting bass notes. The purpose of the 4-bit bass note counter 70B is to provide two separate outputs, one at count 2 and one at count 4 so as to adjust the level of the key comparator input and thereby adjust the intensity level of the bass notes. Thus, at the occurrence of time signal T1, the counter 70B is enabled. The key data or key switch actuations as delivered from the multiplexer is supplied to AND gate 71B along with the clock signals. In addition, a latch circuit or reset circuit 72 supplies a third input to AND gate 71B. Hence, the AND gate 71B passes the key data upon the occurrence of the clock data so that this data is clocked into the 4-bit counter 70B. While there is disclosed a 4-bit counter with only two outputs utilized, e.g., the 2-bit count and the 4-bit count, this could be any number of outputs used for providing any number of levels of voltage to the variable threshold summing point 62. The latch circuit 72 is set initially by pulse T2 and reset of count 4 from the 4-bit counter 70B via OR gate 73B or by the occurrence of time pulse T7 at the end of the bass notes in the time frame. Hence, when the initial state, the threshold level to the key comparator is set by potentiometer 58B. On the occurrence of bass notes in the playing of music, one note played in the bass produces no change in the threshold level. However, if there are two notes played in the bass end of the keyboard, there will be an output on the two output of the bass note counter 70 which through the diode $D_{B1}$ and resistor $R_{B1}$ indicated adjust the level of the voltage at summing point 62. When a third note has been struck, in the same time frame, there is no change in the threshold level, but upon the striking of a fourth note or any greater number, an output appears on the 4-count output of the 4-bit counter which via diode $D_{B2}$ and resistor $R_{B2}$ adjusts the threshold level at summing point 62, and, simultaneously, resets the latch circuit 72B, which is also reset by timing pulse T7 at the end of the bass notes.

The same circuit is utilized for adjusting the threshold level for the treble note counter. In this case, the 4-bit counter 70T is set initially or enabled by time pulse T8. Time pulse T10 is used for resetting the latch circuit 72T and the time pulse T14 is used to reset it at the end of the treble notes. It is also reset in the same way by the occurrence of a 4-bit count.

INTEGRATING COUNTER

The bass level from the output of the key comparator 56 is applied to integrating counter 53 which, in the first instance, has been cleared or reset by the timing pulse signal T0. In addition to the bass level signals are applied to an input terminal of the 5-bit counter 80B. The counter portion provides thirty-two expression levels. With reference to FIG. 4, the time width of the comparator output as applied to the bass level input to the integrating counter 80B is as long as it is high or up, the clock pulses step the counter up to a 32-count level to provide thirty-two expression levels. This counter output is parallel shifted to shift register 84 to provide a parallel to serial conversion every time the 5-bit counter 80B is cleared or reset by the timing pulse signal T0. The shift register 84 has then stored in it the bass expression data. As controls for the shift register 84, there is provided an OR gate 86 to which is applied the key data or key switch actuations, the timing pulse T0 and the timing pulse T15. The pulses from the shift register 84 are supplied in serial order form to AND gate 88 which has as the other input thereto the timing pulse T0. Thus, the pulse T0 enables AND gate 88 at the proper time in the frame of the serial data stream of key switch actuations. The same system is used for providing an integrating counter and outputs for the treble notes.

NOTE STRETCHING

To provide time for the expression circuitry to perform its functions, the key switch data stream is sent through two 128-bit shift registers 90 and 91 before the expression data is inserted. Shift registers 90 and 91 are connected in series with the output of shift register 91 being applied to OR gate 92 and also as the input to the shift register 91. The output of shift register 91 is applied as a second input to OR gate 92 so that the data stream which appears on the output of OR gate 92 is the key data which has been stretched every key switch closure one frame. Thus, OR gate 92 tells what the last frame did and also tells what happens to one bit in the next succeeding frame. These signals are supplied to OR gate 94 which also has as inputs thereto the outputs of AND gates 88B and 88T. The timing applied to AND gate 88B by timing pulse T0 permits the expression bits in shift register 84 to be merged or added to the stream of data issuing from the OR gate 92 in bit positions 4–8, inclusive, as illustrated in the digital multiplex word format or bit assignment chart shown in FIG. 2. In the same way, the treble expression bits stored in shift register 84T are gated by AND gate 88T and the timing pulse T8 to merge with the stream of key data from the OR gate 92 in bit positions 68–72 of the bit assignment chart shown in FIG. 2.

The shift registers 90 and 91 stretch the duration of any note by ORing the outputs in OR gate 92 to thereby remove very sharp or rather mechanical sounds from the short notes. The key count information used to adjust the d.c. compare level by counters 70B and 70T are timed to count the bass and treble notes being played at any given time. The bass and treble note information are combined with the key switch actuations and inserted in the data stream very close to the times when the bits are played which can be a significant improvement over the prior art since in the prior art bit assignment chart and format, the treble and bass information occurred or was positioned in the data stream after the occurrence of the notes to have been played and the present improvement is an important contribution to the art in achieving a more faithful rendition of the music as originally recorded.

It is to be understood that the foregoing description is illustrative of a preferred embodiment of the invention, many other other obvious variations of the invention being suggested to those skilled in the art by the disclosure hereof without departing from the inventive concept, the scope of which is to be determined by the appended claims in light of the prior art and the specification contained herein.

What is clamed is:

1. In a method for recording bass and treble expression effect signals in binary form, respectively, for recreating a musical performance on an electronic player piano wherein serial frames of data cells are provided in a sequence of time division multiplexed frames of data, each frame carrying therein a first group of data bits corresponding to key note actuations of the bass notes on a piano and second group of data bits corresponding to the key note actuations of the treble notes on said piano, the improvements wherein said first and said second groups of data cells are spaced from each other within said time frame, and inserting (1) said bass expression effect signal in binary form in said time division multiplexed frames of data cells in advance of the group of data cells receiving said data bits corresponding to key note actuations of said bass notes and (2) said treble expression effect signal in binary form in said time division multiplexed frames of data cells in advance of the group of data cells receiving said data bits corresponding to key note actuations of said treble notes so that upon recreation of the original musical presentation on said electronic player piano a more faithful rendition of the original performance is produced.

2. The method defined in claim 1 wherein each of said serial frames of data cells with said first and said second groups of data cells spaced from each other and containing said data bits corresponding to key note actuations are momentarily stored; and during said momentary storage, generating said bass and treble expression effect signals in binary bit form and momentarily storing said expression effect signals in binary bit form, and said step of inserting is performed by inserting the momentarily stored expression effect signals in binary bit form in the momentarily stored frames of key note actuations data bits, respectively.

3. The invention defined in claim 2 wherein said momentary stored frames of data is such that each frame of key note actuation is repeated at least one further time in the next, succeding frame of key note actuations prior to insertion of said expression effect signals, and then recording same on magnetic tape.

4. Apparatus for recording bass and treble expression effect signals in digital form for an electronic player piano, the improvement comprising multiplexer means for producing serial time frames of data cells in a sequence of time division multiplexed frames of data cells, the data cells of each frame carrying therein a first group of data bits corresponding to key note actuations of one or more bass notes in said electronic player piano and a second group of data bits corresponding to the key note actuations of one or more treble notes in said electronic player piano, said first and second groups being spaced from each other within each said time frame, and means for inserting said bass expression effect signals in digital form in each of said time division multiplexed frames of data in data cells in advance of said first group of data cells, and inserting said treble expression effect signals in digital form in each of in said time division multiplexed frames of data in data cells in advance of said second group of data cells so that upon re-creation of the original musical presentation on said electronic player piano a more faithful rendition of the original performance is produced.

5. The invention defined in claim 4 including means for recording said time division multiplexed frames of data cells on magnetic tape.

6. The invention defined in claim 4 including at least a pair of shift registers for storing at least two consecutive sequences of frames of data cells containing data bits corresponding to said key note actuations from said multiplexer, means for merging the stored at least two consecutive sequences of frames of data into a single frame, and said means for inserting inserts said bass and treble expression effects in binary from into the merged single frame of key switch actuations.

7. In a musical data storage and retrieval system for use in operating an electrically controlled music generating instrument having selectively actuatable music generating devices which include storage means containing a serial sequence of musical information for operating the music generating devices, said musical information being constituted by a serial sequence of data cells constituting a frame of data and in which a selected group of said data cells are used for storing bass note data and a further group of said data cells are used for storing treble note data, and means for sensing the intensity of the music as played producing a digital signal corresponding thereto, the improvement in said means for sensing includes transducer means for producing an electrical signal proportional to intensity, means for converting the sensed signal to a digital signal comprising a pair of band pass filters, one of said band pass filters being adapted to pass the bass range of notes and the other of said band pass filters being adapted to pass the treble range of said notes, analog to digital converter means for converting the intensity level of music passed by each of said filters to a bass note expression effect signals in digital form and a treble note intensity digital signals resectively, and means for merging said signals into said storage means in a serial sequence with the bass note expression effects signals in digital form preceding the bass note data cells and the treble note expression effect signals in digital form preceding the treble note data cells.

8. A magnetic tape for use in combination with a player piano having a magnetic tape reading unit and selecively actuatable key depression devices, said magnetic tape containing a serial arrangement of data cells physically organized on the tape into a sequential series of data cell frames of fixed length, said data in said data cell frames is in the form of magnetic flux transitions representing clock data and key bass and treble note actuation data and said clock data is adapted to control the translation of each frame of serial data cells to parallel data and apply same simultaneously to said selectively actuable key depression devices to thereby control the recreation of a musical presentation on said player piano, the improvement comprising said data cells in each said frame being divided into at least two groups of data cells, first of said groups of data cells having stored therein the selectively actuated bass key note data bits and the second set of said data cells having stored therein the selectively actuated treble key note data bits, and a selected group of said data cells in each frame preceding said bass key note actuation data cells storing the bass note expression data bits and a further selected group of data cells following said bass note actuation data cells for storing the treble note expression data bits and in a position preceding the data cell bits for storing said treble note actuation data.

9. A magnetic tape as defined in claim 8 wherein the bass and treble key note actuation data bits of each preceding data cell frame is repeated in at least the next succeeding data cell frame to stretch the notes being played.

* * * * *